US007202828B2

(12) United States Patent
Zehngut et al.

(10) Patent No.: US 7,202,828 B2
(45) Date of Patent: Apr. 10, 2007

(54) RF COMMUNICATION DEVICE AND METHOD OF USING IT AND ANTENNA CONSTRUCTION FOR USE IN THE DEVICE AND METHOD

(75) Inventors: Ilan Zehngut, Tel-mond (IL); Ovadia Grossman, Tel Aviv (IL); Haim Slotin, Oranit (IL)

(73) Assignee: Motorola, Inc., Schaumburg, IL (US)

( * ) Notice: Subject to any disclaimer, the term of this patent is extended or adjusted under 35 U.S.C. 154(b) by 0 days.

(21) Appl. No.: 11/159,996

(22) Filed: Jun. 23, 2005

(65) Prior Publication Data

US 2005/0285807 A1 Dec. 29, 2005

(30) Foreign Application Priority Data

Jun. 25, 2004 (GB) ..... 0414231.1

(51) Int. Cl.
*H01Q 1/04* (2006.01)
*G08B 23/00* (2006.01)

(52) U.S. Cl. ..... 343/719; 340/870.02

(58) Field of Classification Search ..... 343/719, 343/748, 791; 340/870.02
See application file for complete search history.

(56) References Cited

U.S. PATENT DOCUMENTS 2,455,224 A 11/1948 Buchwalter
5,298,894 A * 3/1994 Cerny et al. ..... 340/870.02
6,177,883 B1 1/2001 Jennetti et al.
6,378,817 B1 4/2002 Bublitz
6,653,945 B2 * 11/2003 Johnson et al. ..... 340/870.02

FOREIGN PATENT DOCUMENTS

GB 1327864 A 4/1971
GB 2326002 A 9/1998
GB 2212985 A 2/1999
GB 2353142 A 2/2001

* cited by examiner

*Primary Examiner*—Shih-Chao Chen

(57) ABSTRACT

A device comprising a RF transmitter, a casing for the RF transmitter and, connected to and extending from the RF transmitter, an antenna for radiating RF signals produced by the RF transmitter, the antenna comprising an elongated member having a first portion and a second portion each of which comprises a first conductor, a second conductor and an insulator between the first conductor and the second conductor, and, between the first portion and the second portion, a third portion comprising a first conductor, wherein the first conductor of each of the first portion, the second portion and the third portion is a common conductor connected to the RF transmitter and wherein the second conductor of the first portion and the second conductor of the second portion are electrically isolated from one another.

26 Claims, 2 Drawing Sheets

RF COMMUNICATION DEVICE AND METHOD OF USING IT AND ANTENNA CONSTRUCTION FOR USE IN THE DEVICE AND METHOD

FIELD OF THE INVENTION

This invention relates to a RF communication device and a method of using it and also an antenna and an antenna construction for use in the device and method. In particular, it relates to a device which is useful in data communication in automatic meter reading applications.

BACKGROUND OF THE INVENTION

Automatic meter reading is a growing art in which a remotely located meter measures a physical property of the neighbouring environment and provides a measurement signal to a local radio communication device. The device sends a RF signal to a remote receiver indicating the value of the measurement signal. The device may also receive an incoming RF signal from a remote transmitter.

The purpose of the present invention is to provide an improved RF device and method which is useful in different configurations and in different application situations for automatic meter reading and an antenna and antenna construction which is useful in the device and method.

BRIEF DESCRIPTION OF THE DRAWINGS

Embodiments of the present invention will now be described by way of example with reference to the accompanying drawings, in which.

DESCRIPTION OF EMBODIMENTS OF THE INVENTION

Figure 1:
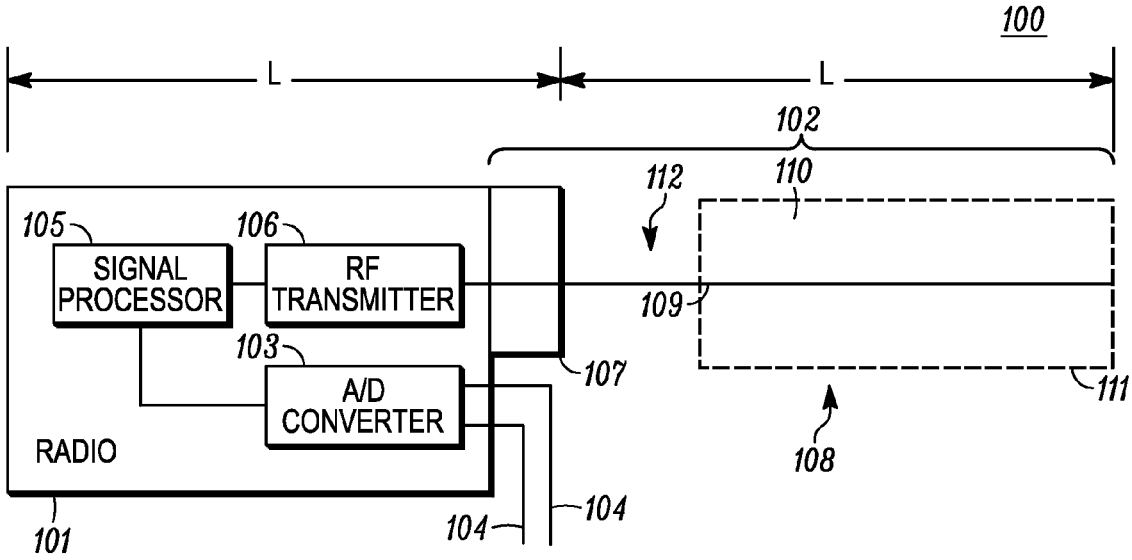
FIG. 1 is a schematic diagram, partly in block circuit form, of a radio and antenna embodying the invention in its simplest form.

FIG. 1 is a diagram, partly in block schematic form, of a radio device 100 embodying the invention. The device 100 is for use in RF communications such as data transfer, in particular for automatic meter reading. The device 100 illustrates an embodiment of the invention in its simplest form. The device 100 comprises a RF communication unit 101 attached to an antenna 102. The unit comprises an A/D (analogue to digital) converter 103 having input conductors 104, a signal processor 105 and a RF transmitter 106. Electrical measurement signals from a meter (not shown) are provided to the A/D converter 103. The A/D converter 103 produces output digital data suitable for processing by the signal processor 105. The signal processor 105 produces baseband modulation data. The data is applied to modulate a RF carrier signal generated in the RF transmitter 106. The modulated RF signals produced are radiated for transmission to a remote receiver (not shown) by the antenna 102 as follows.

The antenna 102 is a flexible elongated structure which comprises a short first portion 107 of coaxial cable. An output terminal of the RF transmitter 106 is connected to the short first portion 107. The antenna 102 also comprises a second portion 108 which comprises a coaxial cable. The coaxial construction of the first portion 107 and the second portion 108 is the same (although the lengths of the two portions is likely to be different) and is illustrated in particular by the second portion 108 which consists of an inner conducting wire 109, an insulating sleeve 110 on the conducting wire 109 and an outer screening conductor 111 covering the outer surface of the insulating sleeve 110. The inner conducting wire 109 of the coaxial cable is common to the first and second portions 107, 108 and extends between the two in a third portion 112 where it has no outer conductor. In practice, an outer insulating sheath (not shown) is provided over the outer screening conductor 111.

The effective electrical length of the RF transmitter 106 and the first portion 107 of coaxial cable is a length L. The effective electrical length of the second coaxial portion 108 and the third portion 112 is also L. The third portion 112 and the second portion 108 constitute a quarter wave elongated monopole radiator. The RF transmitter 106 (in practice a conducting path in the transmitter 106) and the first coaxial portion 107 form a counter poise to this radiator. Thus, the length L is equivalent to a quarter of the wavelength at the centre frequency of the band of RF radiation to be emitted, and if appropriate (if the transmitter 106 is part of a transceiver) received, by the radiator.

The third portion 112 may for all frequencies in the range 0 Hz to 2 GHz have a length in the range of from 1 mm to 5 mm. The length is not critical at frequencies below 1 GHz.

The unit 101 may also be operable to receive and process incoming RF signals via the antenna 102 from a remote transmitter (not shown). In this case, the unit 101 comprises a RF receiver (not shown) connected to the antenna 102 which may have some parts combined with the RF transmitter in a transceiver.

Figure 2:
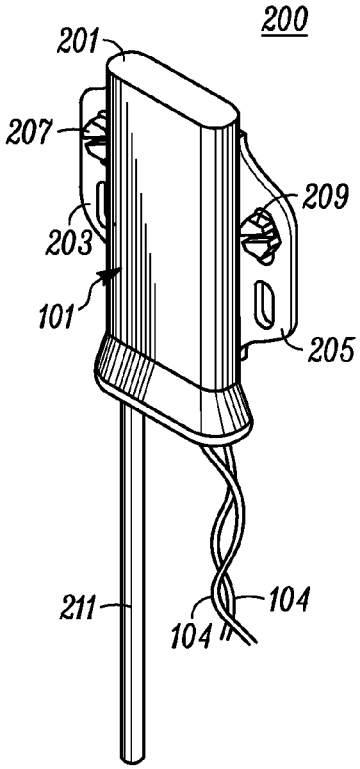
FIG. 2 is a front view of a radio and antenna embodying the invention shown in a wall hanging mode of use.

FIG. 2 shows a wall mounted version 200 of the device 100 of FIG. 1. The radio unit 101 has an outer case 201 having flanges 203, 205 by which it may be attached to a wall by screws 207 and 209. The antenna 102 (comprising the second portion 108 and the third portion 112) hangs vertically from the case 201. The antenna 102 has in this case an outer insulating sheath indicated by reference numeral 211. The conductors 104 are connected to the A/D converter (inside the case 201) through the case 201 to allow external electrical connections to be made. For example, where the device 100 is used in an automatic meter reading application, the conductors 104 may be connected to a meter (not shown) which remotely measures a physical parameter such as temperature or humidity and provides an electrical output which is provided as an analogue signal to the A/D converter 103 (FIG. 1) via the conductors 104.

In use, the antenna 102 shown in FIG. 2 hangs freely in a vertical position by the action of gravity and thereby provides a vertical monopole radiator. In this form the antenna 102 produces a balanced radiation pattern, with a peak toward the horizon, i.e. in an azimuth plane, as the length L of the radiator part of the antenna 102 and its counterpoise is the same. Thus the polarisation of emitted radiation is always vertical as required, independent of the specific installation configuration. Also, if required, the antenna 102 intercepts incoming radiation having a vertical polarization.

Figure 3:
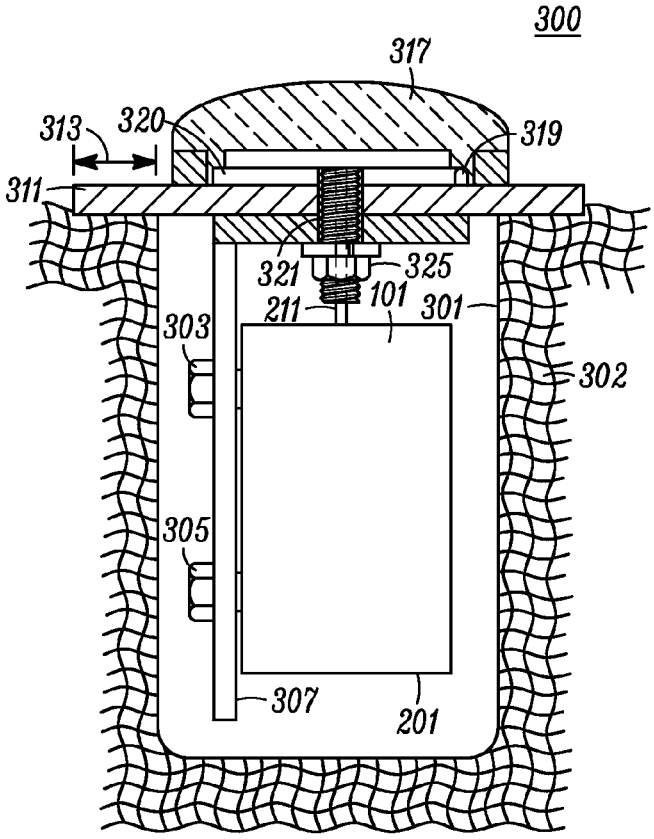
FIG. 3 is a cross-sectional side elevation of a radio and antenna embodying the invention for use in a pit enclosed mode of use.

FIG. 3 is a cross-sectional side elevation of a RF radio and antenna device embodying the invention for use in a pit enclosed mode of use. Parts having the same reference numerals as parts in one or more of the earlier FIGS. have the same function as such parts. In FIG. 3, the form 200 of the device has been reconfigured to a form 300. In the form 300, the device is partially enclosed in a pit 301 formed in the ground, shown as 302. The radio device 101 has a case 201 which is attached by bolts 303, 305 to a vertical mounting plate 307. The mounting plate 307 is attached to a horizontal mounting plate 309 to form a mounting bracket. The mounting plate 309 is in turn attached to a cover plate 311. The cover plate 311 covers the pit 301 and rests on the ground 302 around the edges of the pit 301 in an annular region 313. The antenna 102 in this case points vertically upward and at its upper end part of the cable forming the second portion 108 extends to form also a horizontal coil 315, to be described in more detail later with reference to FIG. 5, forming an antenna top loading.

Figure 4:
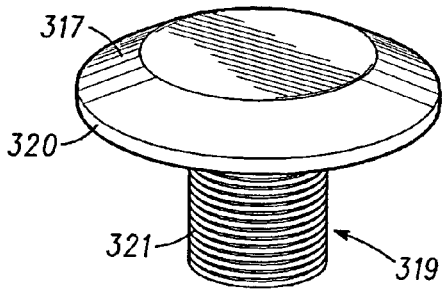
FIG. 4 is an exploded front perspective view of a cap forming part of the device shown in FIG. 3.
Figure 5:
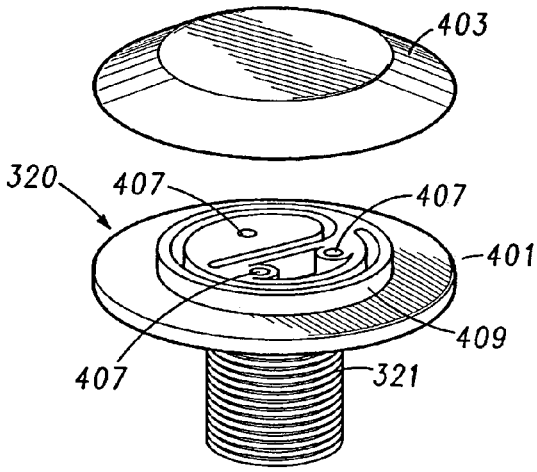
FIG. 5 is an exploded front perspective view of the cap of FIG. 4.
Figure 6:
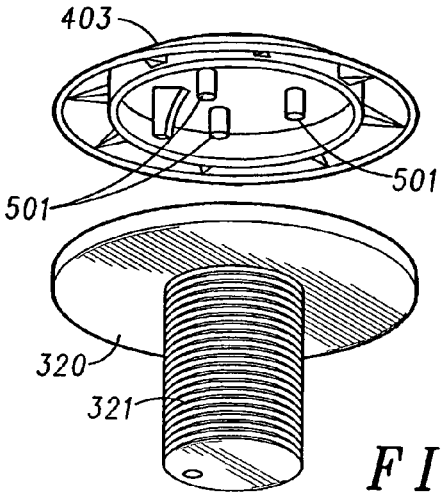
FIG. 6 is a further exploded front perspective view of the cap of FIG. 4 showing an underside of a top part of the cap.

As shown in FIG. 3 and also in FIGS. 4–6, a stud 319 has a head 320 and a hollow threaded portion 321 and a cap 317 is fitted to the head 320. The stud 319 and cap 317 form a cover for the antenna 102. The threaded portion 321 is fitted snugly (FIG. 3) through a hole in the cover plate 311 and is attached to the horizontal mounting plate 309 by a spring loaded washer and nut 325. The antenna 102 passes through the hollow interior of the stud 319 and forms the coil 315.

As seen in FIG. 4, the cap 317 is fitted to the outer side of the head 320 of the stud 319. FIG. 4 also shows that the threaded portion 321 may be offset with respect to the centre of the head 320 and the cap 317 to facilitate assembly of the antenna in its cover.

The cap 317 and the head 320 form two interfitting parts which are shown separated in FIGS. 5 and 6. These parts may be made of a strong mouldable insulating material such as fibre reinforced plastics material, e.g. nylon. As shown in FIG. 5 the head 320 has a disc shaped part 401 on the outer surface of which is an integrally formed protruding member 409 in the shape of a coil providing a coiled recess in which the antenna 102 is fitted to provide the coil 315 (not shown in FIGS. 5 and 6) referred to earlier with reference to FIG. 3.

The cap 317 is fitted to the head 320 by plugs 501 (shown in FIG. 6) formed on its underside surface which are attached to complementary sockets 407 (FIG. 5) formed on the disc shaped part 401. After assembly of the head 320 and the cap 317, the two may be sealed together, e.g. by ultrasonic welding.

Figure 7:
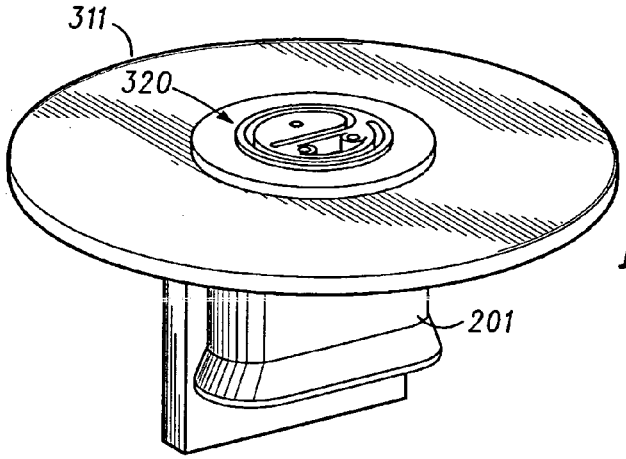
FIG. 7 is a top perspective view of the device of FIG. 3 showing a cover in which part of the cap of FIGS. 4–6 is fitted.

FIG. 7 shows the device form 300 of FIG. 3 with the disc shaped part 401 of the head 320 fitted flush in a suitably provided slot in the cover plate 311.

Figure 8:
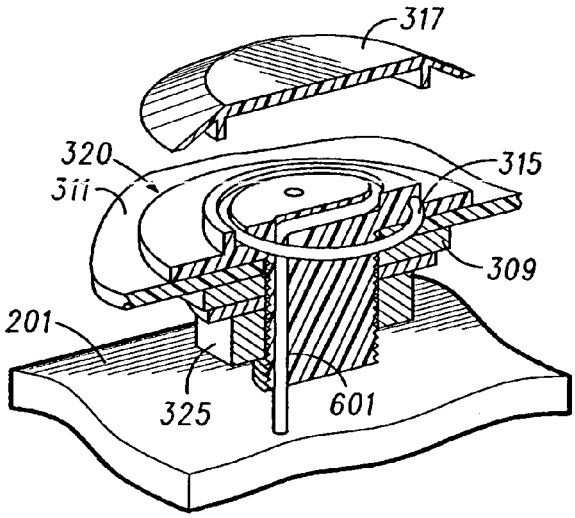
FIG. 8 is a partly cut away cross-sectional front perspective view of the device of FIGS. 3 and 7.

In FIG. 8 part of the cover plate 311 and part of the stud 319 is shown cut away so that the antenna 102, comprising the part forming the coil 315, may be seen. The antenna 102 has an outer insulating sheath 601. The stud 319 with the antenna 102 fed through it provides protection of the components of the assembly inside the pit 301 from water, e.g. rainwater, present on the ground 302.

The novel form 300 beneficially gives ease of installation in the pit 301 and ensures that the antenna 102, although made of flexible material, will be fixed in its final position. In particular, the novel construction of the head 320 and the cap 317 allows smooth insertion of antenna cable to form the antenna 102 comprising the coil 315. No installation tool is required for this and the configuration guarantees that the antenna 102 will be fixed in its final position.

Inside the pit 301, below the cover plate 311, the antenna 102 is a counterpoise, and above the cover plate 311 it is a short top loaded vertical polarisation monopole. A typical height of the coil 315 above the ground is 1 to 2 cm.

The coil 315 forms a top loading extended portion of the antenna 102. Preferably, the coil shape and size are suitable to provide a high quality factor and not induce substantial losses by lowering the efficiency. Provision of such properties is a matter of design which may readily be applied by a person of ordinary skill in the antenna art. Preferably, the coil 315 comprises one turn or loop. The coil 315 acts as a radiator in itself (as well as a load to the vertical part of the antenna 102) and radiates electromagnetic energy in a horizontal polarization, thus providing polarization diversity.

Owing to the various propagation conditions through which a signal transmitted from a remote transmitter is sent to and received by the antenna 102, the signal may be received in different polarizations. Consequently, it is beneficial for the antenna 102 to be able to pick up signals in different polarizations, i.e. both vertical and horizontal polarizations.

The efficiency of the antenna 102 is high, for the given embodiment of form 300 (FIG. 3) and even if the pit 301 is in the form of Faraday cage, the radiation penetration outside the pit 301 is beneficially only about 10–15 db below a possible peak, which peak is about +2 dbi.

The configuration of the form 300 shown in FIGS. 3 to 8 is particularly suitable to minimise the effects of Rayleigh fading owing to unwanted ground reflections. This is explained further as follows. If an antenna extends higher than a particular minimum height above the ground, it receives from a remote transmitter two RF signal components from the transmitter—a direct signal component and a signal component reflected from the ground. When the phase difference between the two components is 180 degrees, a null in the received radiation pattern is created. In particular, the point where the two parts of the antenna, namely the vertically disposed second portion 108 of the linear elongated part and the horizontally disposed coil 315, are joined acts as a so called phase centre and this is lower in height than the minimum height above the cover plate 311 to cause a significant Rayleigh fading problem.

The antenna cover, as shown in FIG. 4, is preferably assembled as a one piece unit. All of the internal parts as shown in FIGS. 5, 6 and 7 may be attached together, e.g. by ultrasonic welding, at an assembly factory.

A procedure which may be used to install the device of the form 300 shown in FIGS. 3 to 8, comprising a pre-assembled antenna cover, in a pit 301 is as follows:

1. The cover 311 is removed from the pit 301.
2. A hole is drilled through the cover 311.
3. The antenna housing (as shown in FIG. 4) is passed through the hole.
4. The bracket comprising the mounting plate 309 is attached to the threaded portion 321 of the antenna cover using the nut 325.
5. The antenna cable is pushed through the hollow threaded portion 321 until the case 201 reaches the edge of the threaded portion 321.
6. The case 201 comprising the radio unit 101 is mounted to the mounting plate 307, using bolts 303, 305.

7. The conductors 104 are connected to the output wires of a meter (not shown). (The input to the radio device 101 could alternatively be a digital input such as provided by dry contact pulses).
8. The cover 311 is replaced.

The invention claimed is:

1. A device comprising:

a RF transmitter, a casing for the RF transmitter and, connected to and extending from the RF transmitter, an antenna for radiating RF signals produced by the RF transmitter, the antenna comprising an elongated flexible member having a first portion and a second portion each of which comprises a first conductor, a second conductor and an insulator between the first conductor and the second conductor, and, between the first portion and the second portion, a third portion comprising a first conductor, wherein the first conductor of each of the first portion, the second portion and the third portion is a common conductor connected to the RF transmitter, wherein the second conductor of the first portion and the second conductor of the second portion are electrically isolated from one another, and wherein the second and third portions of the elongated flexible member form a radiator having a combined effective electrical length equivalent to a quarter of the wavelength of radiation to be emitted by the radiator.

2. The device according to claim 1 wherein the first portion and the second portion of the elongated member comprise coaxial cable portions.

3. The device according to any claim 1, wherein the first portion and the RF transmitter have a combined effective length which matches the combined effective length of the second and third portions.

4. The device according to claim 1 wherein the antenna further comprises a top loading fourth portion, wherein the second and third portions form a linear elongated portion and the top loading fourth portion is in a plane substantially perpendicular to the linear elongated portion.

5. The device according to claim 4 wherein the top loading fourth portion comprises a planar coil formed of a coaxial cable.

6. The device according to claim 5 wherein the coaxial cable is an extension of a coaxial cable forming the second portion.

7. The device according to claim 5 further comprising a cover for the antenna wherein the cover comprises a track to receive the coaxial cable to form the coil.

8. The device according to claim 1 further comprising a case for the RF transmitter and means for attaching the case to a member having a vertical surface in a configuration in which the elongated member extends substantially vertically.

9. The device according to claim 8 wherein the device is attached to a member having a vertical surface with the antenna hanging downward from the RF transmitter.

10. The device according to claim 9 further comprising an attachment member having a surface to which the case of the RF transmitter is attached providing a configuration wherein in use the antenna extends upward from the RF transmitter.

11. The device according to claim 10 further comprising a further attachment member attached to the first mentioned attachment member substantially perpendicular to the first mentioned attachment member.

12. The device according to claim 10 wherein the RF transmitter and at least a part of the elongated member are located in an enclosure.

13. The device according to claim 11 wherein the enclosure is a pit and the further attachment member is attached to a cover for the pit.

14. The device according to claim 13 comprising an antenna cover extending through the cover for the pit.

15. The device according to claim 13 wherein the antenna comprises a coil portion inside the antenna cover.

16. The device according to claim 1 wherein the device is adapted to be fitted alternatively to a wall with the antenna extending below the casing or in an enclosure with the antenna extending above the casing.

17. An antenna comprising an elongated linear part; and a coiled part;

wherein the elongated linear part comprises a first portion and a second portion each of which comprises a first conductor, a second conductor and an insulator between the first conductor and the second conductor, and, between the first portion and the second portion, a third portion comprising a first conductor, wherein the first conductor of each of the first portion, the second portion and the third portion is a common conductor connectable to an RF transmitter, wherein the second conductor of the first portion and the second conductor of the second portion are electrically isolated from one another and wherein the coiled part comprises a coil in a plane substantially perpendicular to the elongated linear portion, and wherein the second and third portions of the elongated linear part form a radiator having a combined effective electrical length equivalent to a quarter of the wavelength of radiation to be emitted by the radiator.

18. The antenna according to claim 17 wherein the coiled part comprises a first conductor and a second conductor and the first conductor of the coiled part is connected to the first conductor of the second portion of the elongated linear part.

19. The antenna of claim 18 wherein a common coaxial cable forms the coiled part and the second portion of the elongated linear part.

20. The antenna according to claim 17 further comprising means for attaching the antenna to a mounting member whereby the antenna can be fixed in a configuration with the elongated linear portion substantially vertical and the coiled portion substantially horizontal.

21. The antenna according to claim 17 further comprising an antenna cover wherein the antenna cover comprises a track to form the coiled part.

22. The antenna according to claim 21 wherein the antenna cover is attachable to an enclosure cover suitable for covering an enclosure.

23. The antenna according to claim 17, wherein the first portion when connected to an RF transmitter has together with the transmitter a combined effective length which matches the combined effective length of the second and third portions.

24. A device comprising:

a RF transmitter, a casing for the RF transmitter and, connected to and extending from the RF transmitter, an antenna for radiating RF signals produced by the RF transmitter, the antenna comprising an elongated member having a first portion and a second portion each of which comprises a first conductor, a second conductor and an insulator between the first conductor and the second conductor, and, between the first portion and the second portion, a third portion comprising a first conductor, wherein the first conductor of each of the first portion, the second portion and the third portion is a common conductor connected to the RF transmitter, wherein the second conductor of the first portion and the second conductor of the second portion are electrically isolated from one another, wherein the antenna further comprises a top loading fourth portion, wherein the second and third portions form a linear elongated portion and the top loading fourth portion is in a plane substantially perpendicular to the linear elongated portion, and wherein the top loading fourth portion comprises a planar coil formed of a coaxial cable.

25. The device according to claim 24 wherein the coaxial cable is an extension of a coaxial cable forming the second portion.

26. The device according to claim 24 further comprising a cover for the antenna.

* * * * *